US006974211B2

(12) United States Patent
Haines et al.

(10) Patent No.: US 6,974,211 B2
(45) **Date of Patent: *Dec. 13, 2005**

(54) FILTER FOR AN INK JET PEN

(75) Inventors: Paul Mark Haines, Lebanon, OR (US); James W. Ring, Blodgett, OR (US); Gary D. Tarver, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 27 days.

This patent is subject to a terminal disclaimer.

(21) Appl. No.: 10/617,952

(22) Filed: Jul. 10, 2003

(65) Prior Publication Data

US 2004/0104982 A1 Jun. 3, 2004

Related U.S. Application Data

(63) Continuation of application No. 10/051,892, filed on Jan. 18, 2002, now Pat. No. 6,644,797.

(51) Int. Cl.[7] ..... B41J 2/175
(52) U.S. Cl. ..... 347/93
(58) Field of Search ..... 347/84–86, 93, 347/92; 210/493.1, 348, 398

(56) References Cited

U.S. PATENT DOCUMENTS

| | | | | |
|---|---|---|---|---|
| 5,537,136 | A | 7/1996 | Brandon et al. | |
| 5,546,109 | A | 8/1996 | Nakano | |
| 5,631,682 | A | 5/1997 | Takata | |
| 5,821,965 | A | 10/1998 | Oda et al. | |
| 5,949,458 | A | 9/1999 | Studholme | |
| 6,152,560 | A | 11/2000 | Hollands | |
| 6,234,623 | B1 | 5/2001 | Drake | |
| 6,254,229 | B1 | 7/2001 | Bohorques et al. | |
| 6,524,479 | B2 * | 2/2003 | Schwinghammer | 210/493.1 |
| 6,572,214 | B2 * | 6/2003 | Otis et al. | 347/23 |
| 6,588,891 | B1 * | 7/2003 | Steven et al. | 347/93 |
| 6,644,794 | B1 | 11/2003 | Wilson et al. | |
| 6,644,796 | B2 | 11/2003 | Olsen | |
| 6,644,797 | B2 * | 11/2003 | Haines et al. | 347/93 |

* cited by examiner

*Primary Examiner*—Lamson Nguyen

(57) ABSTRACT

An inkjet pen is disclosed having an interior chamber containing a pressure regulator. A filter within the interior chamber substantially surrounds the pressure regulator, providing a large filter surface area, and hence a low resistance to ink flow. The filter may be formed of a pleated filter material; the filter material may be retained by a rigid ink passage flange and a filter cap.

8 Claims, 8 Drawing Sheets

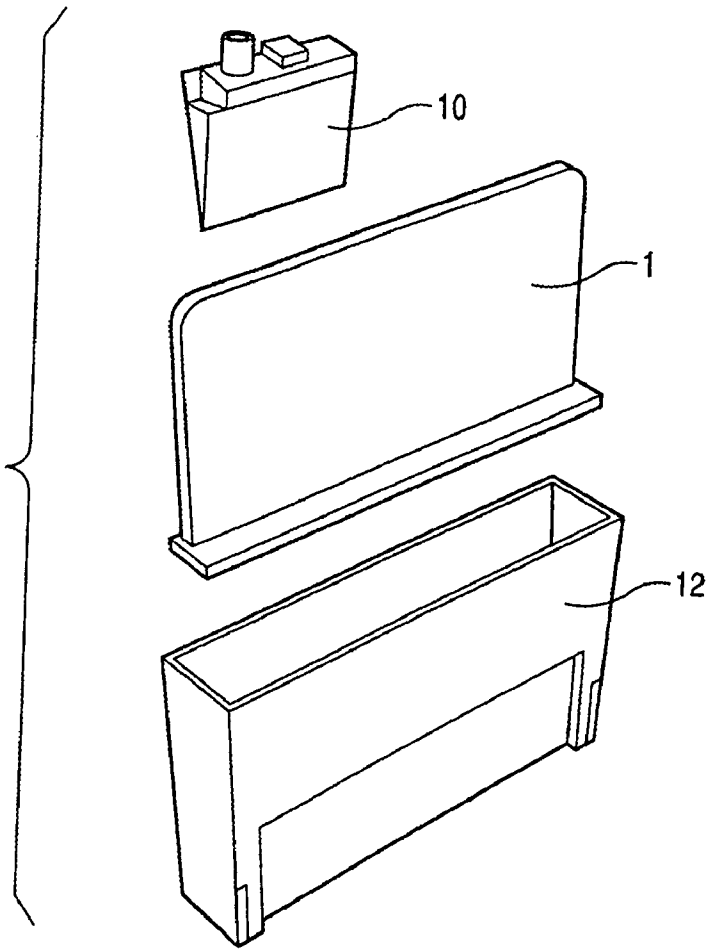
Fig. 10
Fig. 9
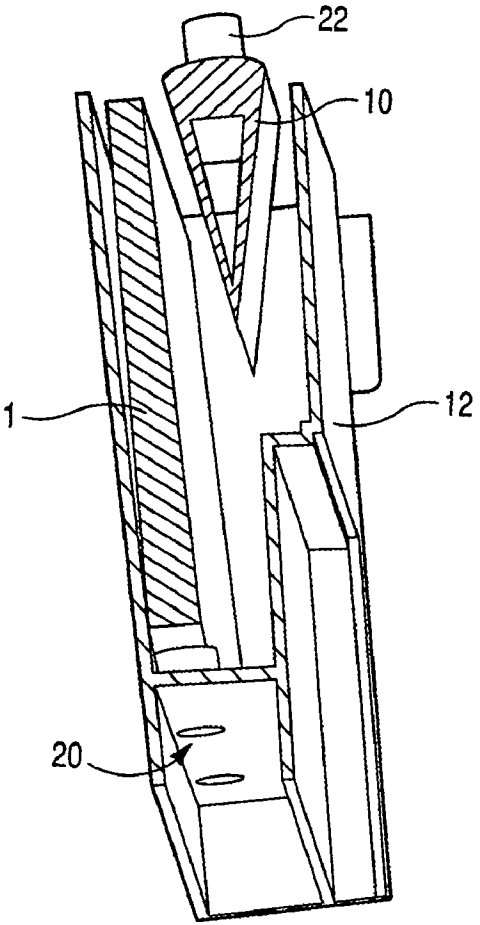

FILTER FOR AN INK JET PEN

This is a continuation of application Ser. No. 10/051,892, filed Jan. 18, 2002, now U.S. Pat. No. 6,644,797.

BACKGROUND OF THE INVENTION

Ink jet pens typically require an ink filter to be placed between the ink reservoir and the nozzle, preferably close to the nozzle, to filter out particles and impurities in the ink. These particles often arise either from poor processing of the ink prior to insertion into the pen, or from unsanitary conditions during the assembly of the pen. If a particulate of a dimension larger than an ink flow passage were to get stuck in the passage, it could slow or prevent the flow of ink to the nozzle. Thus, an effective filter prevents an early failure of the ink jet pen due to such a particulate, and prolongs its life by reducing long-term contamination.

Filters for ink jet pens have taken on many forms. For example, U.S. Pat. No. 6,254,229 to Bohorquez et al. discloses a filter member having a plurality of holes coupled to a flat microscreen filter. U.S. Pat. No. 6,234,623 to Drake discloses first and second filter arrays patterned onto layers. U.S. Pat. No. 5,537,136 to Brandon et al. discloses a filter cap including a mesh material formed into a dome-shaped configuration. U.S. Pat. No. 6,152,560 to Hollands discloses a filter element made of a sheet-like material having a curved shape. U.S. Pat. No. 5,949,458 discloses a fibrous body to act as a filter. U.S. Pat. No. 5,546,109 to Nakano discloses a flat filter member that is interposed between two thin films permeable to air.

However, as pen performance increases, a higher ink flow rate is required, thus requiring a higher effective filtration surface area of the filter media. Typically, the filters in the prior art have small effective filtration surface areas. There is thus a need for ink jet filters having a larger effective filtration surface area and, hence, a higher filtration rate.

SUMMARY OF THE INVENTION

Embodiments of the present invention provide a filter for an ink jet pen, comprising a filter material configured to attach to the pen, wherein a flow of ink through the filter material is substantially multidirectional. In a preferred aspect, an effective filtration surface area of the filter is substantially greater than any projection surface area of the filter. In another preferred aspect, the filter, which is cylindrical or rectangular in cross section, comprises a chamber at least partially bounded by the filter material, and preferably the filter material comprises more than half of a surface area of the chamber. Further, a flow direction of ink into the chamber is substantially different than a flow direction of ink from the chamber. In another preferred aspect, the filter material, which is pleated and comprises pores having a dimension substantially less than a dimension of a smallest ink flow passage in the pen, is configured to attach to the pen via an ink passage flange. In one preferred aspect, ink flows into the chamber via the flange; in another, ink flows from the chamber via the flange. The flange is attached to the filter material either by an adhesive or by melting the flange. In other preferred aspects, the chamber is configured to house a regulator, the filter comprises ribs, and the filter comprises a bag, which is preferably folded, and which comprises two sheets of filter material sealed together.

The present invention also provides for a filter for an ink jet pen, comprising a filter material configured to attach to the pen, wherein an effective filtration surface area of the filter is substantially greater than any projection surface area of the filter. Further, the filter comprises a chamber more than half bounded by the filter material and a flow direction of ink into the chamber is substantially different than a flow direction of ink from the chamber.

The present invention also provides for an ink jet pen, comprising a pen body and a filter, wherein the filter comprises a filter material for filtering ink, and wherein a flow of ink through the filter is substantially multidirectional. In a preferred aspect, an effective filtration surface area of the filter is substantially greater than any projection surface area of the filter. In another preferred aspect, the filter, which is cylindrical or is rectangular in cross section, comprises a chamber at least partially bounded by the filter material, and preferably the filter material comprises more than half of a surface area of the chamber. Further, a flow direction of ink into the chamber is substantially different than a flow direction of ink from the chamber. In another preferred aspect, the filter material, which is pleated, comprises pores having a dimension substantially less than a dimension of a smallest ink flow passage in the pen. The filter further comprises an ink passage flange to attach the filter to the pen body. In one preferred aspect, ink flows into the chamber via the flange; in another, ink flows from the chamber via the flange. The flange is attached to the filter material either by an adhesive or by melting the flange. In other preferred aspects, the pen further comprises a regulator (preferably positioned inside the chamber), the filter comprises ribs, and the filter comprises a bag, which is preferably folded, and which comprises two sheets of filter material sealed together.

The present invention also provides for a method of filtering ink in an ink jet pen, comprising flowing the ink through a filter material configured to attach to the pen, wherein a flow of ink through the filter material is substantially multidirectional. In a preferred aspect, an effective filtration surface area of the filter material is substantially greater than any projection surface area of the filter material. Further, the filter material bounds a chamber, where the chamber is more than half bounded by the filter material, and where a flow direction of ink into the chamber is substantially different than a flow direction of ink from the chamber.

BRIEF DESCRIPTION OF THE DRAWINGS

FIG. 9 is a perspective view of a cross section of an ink jet pen according to the fourth embodiment of the present invention.

FIG. 10 is an exploded view of the ink jet pen shown in FIG. 9.

DETAILED DESCRIPTION OF THE PREFERRED EMBODIMENTS

Figure 1:
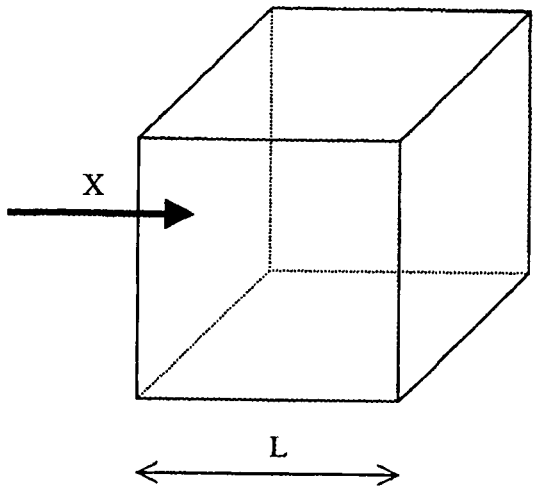
FIG. 1 is a perspective view of a cube-shaped filter.

Referring to FIG. 1, a hollow cube-shaped filter of side length L is shown. A liquid medium flows through the filter in a direction normal to one of the surfaces, indicated by the arrow labeled X. The "effective filtration surface area" of the filter is the area effectively "seen" by the liquid medium as it flows through the filter. The effective filtration surface area of the filter will now be explained with regard to its total surface area and its projection surface area. In the example shown in FIG. 1, the total surface area of the filter is just the surface area of the cube, or 6 $L^2$. The projection surface area of the filter in the X direction is just the surface area of one side, or $L^2$. The effective filtration surface area of the filter is, in this example, equal to the projection surface area in the X direction, or $L^2$.

However, if, instead of the liquid medium flowing in the X direction, the liquid medium flows from the inside of the cube outward—hence multidirectionally—the effective filtration surface area would be the total surface area of the cube, or $6L^2$, which is significantly greater than the projection surface area of $L^2$. Therefore, the ability to filter a liquid medium by flowing the medium multidirectionally through the filter has the advantage of increasing the effective filtration surface area without the need for increasing the volume of the filter.

Figure 2:
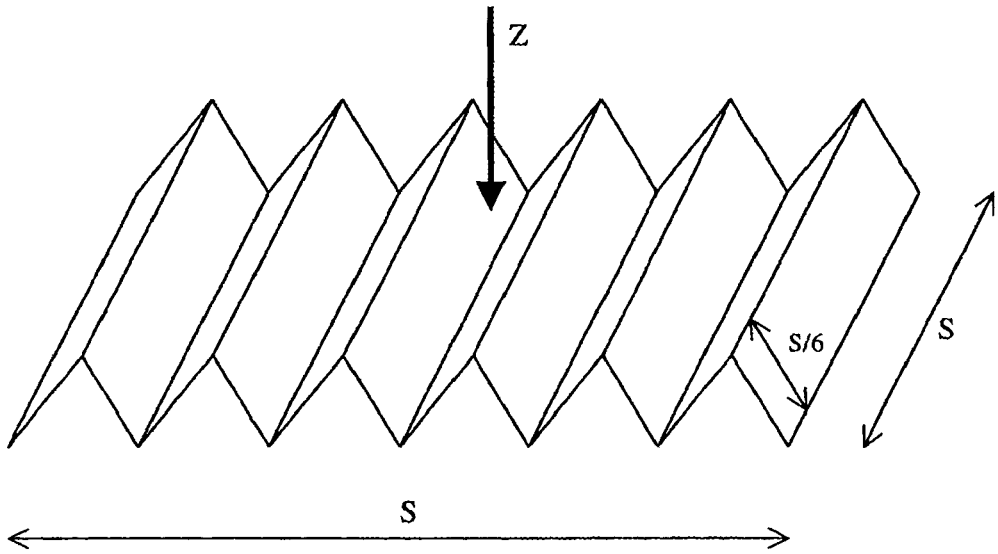
FIG. 2 is a perspective view of a pleated filter, as contemplated by the present invention.

Now consider a square filter of side length S that is pleated as shown in FIG. 2. Each of the 12 pleats has a length S/6. A liquid medium flows through the filter in a direction normal to the square, indicated by the arrow labeled Z. The projection surface area in the Z direction is just $S^2$. However, the effective filtration surface area is 12 ($S^2/6$), or 2 $S^2$, significantly greater than the projection surface area of $S^2$. Therefore, the use of a pleated filter over a conventional flat filter also has the advantage of increasing the effective filtration surface area without the need for increasing the volume of the filter.

Figure 3:
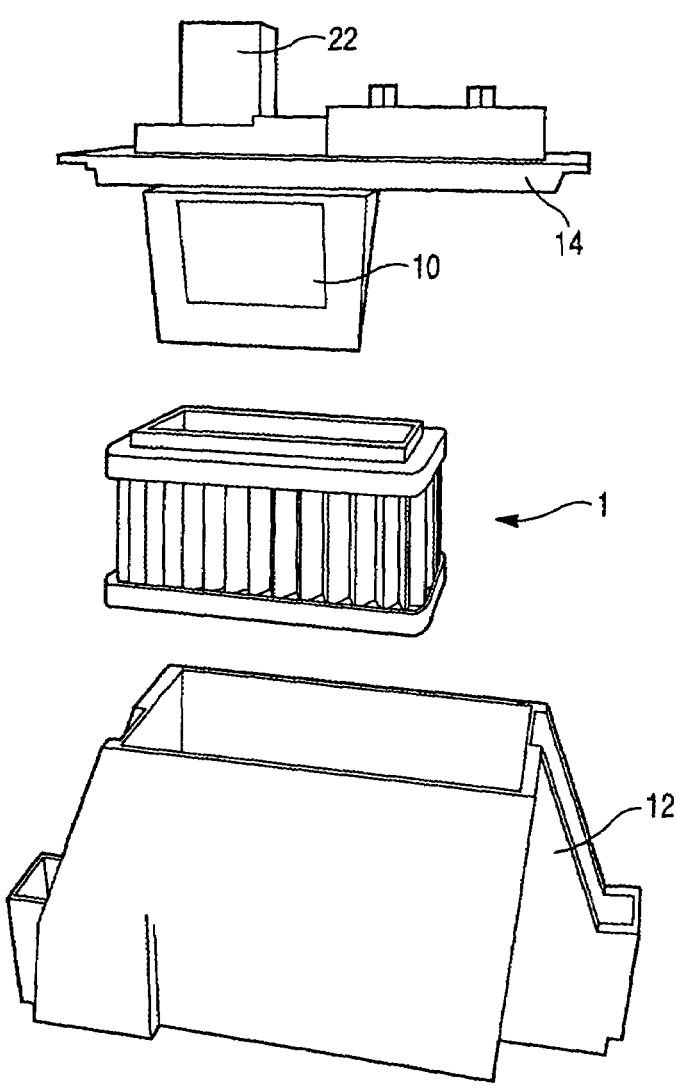
FIG. 3 is an exploded view of an ink jet pen with a filter according to the first embodiment of the present invention.

Referring to FIG. 3, according to a first embodiment of the present invention, an ink jet pen comprises a pen body 12, a filter 1, a pressure regulator 10, a pen cap 14, and an ink entrance 22. The pen body 12 contains an ink reservoir from which ink is fed to a nozzle. The nozzle (not shown) can either be attached directly to the pen body 12 or to an ink jet printing device. The regulator 10 regulates the pressure inside the pen body 12 in order to provide a desired flow rate of ink to and from the pen body 12. When the pen is assembled, the regulator 10 fits inside the filter 1, which both fit inside the pen body 12.

Figure 4:
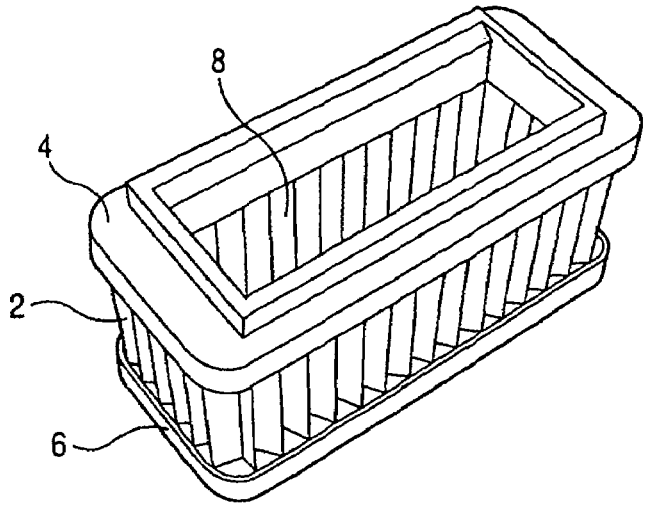
FIG. 4 is a perspective view of the filter shown in FIG. 3.
Figure 5:
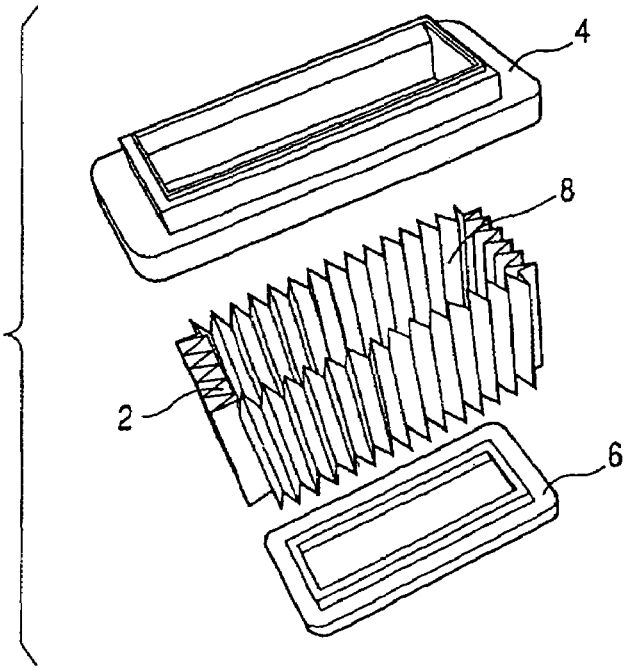
FIG. 5 is an exploded view of the filter shown in FIG. 4.

Referring to FIGS. 4 and 5, the filter 1 comprises a filter cap 6, an ink passage flange 4, and a filter material 2 therebetween forming a chamber 8. The filter material 2 comprises a porous material with pores that are sufficiently small so that any particles that pass through the filter are not large enough to block or retard the flow of ink through any passage. For example, but not by way of limitation, the pores in one exemplary embodiment have dimensions or diameters that are less than one-third a dimension of the smallest ink flow passage in the pen. As another exemplary embodiment, the pores have diameters between 2 microns and 10 microns. The filter material 2 could comprise a stainless steel wire screen that is woven or randomly oriented. It could also comprise one of fiberglass, plastic, and natural fiber (e.g., paper). Other possible materials for the filter material 2 would be obvious to one skilled in the art.

In the first embodiment, the filter material 2 is pleated as shown in FIGS. 4 and 5. The pleated construction of the filter material 2 adds structure and support to the filter, as well as additional effective filtration surface area, as demonstrated with regard to FIG. 2. This has the advantage of increasing the flow rate through the filter given a constant pressure differential through the filter.

The pleated filter material 2 is looped into a rectangular shape, as shown in FIG. 5, to create the chamber 8 inside. The filter cap 6 is impervious to the ink and serves both as a cap to seal the chamber 8 as well as a structural support for the filter material 2. The ink passage flange 4 serves as a means to attach the filter material 2 to the ink jet pen. The filter material 2 is attached to the filter cap 6 and the ink passage flange 4 with an adhesive. If the filter cap 6 and ink passage flange 4 are made of a plastic or meltable material, the filter material 2 could, in an alternative embodiment, be attached to the filter cap 6 and the ink passage flange 4 by slightly melting the meltable material around the filter material 2, thus embedding the filter material 2 thereto. Other means of attachment would be obvious to one skilled in the art.

The attachment also serves to seal the filter material 2 to the filter cap 6 and the ink passage flange 4. When the filter 1 is fully assembled with the ink jet pen, the ink passage flange 4 is sealed to the pen cap 14 and surrounds the regulator 10. (This is analogous to the inside-out configuration of the filter shown in FIG. 1.) Then, when an ink pressure gradient arises between the inside (chamber 8) of the filter 1 and the outside of the filter 1, a flow of ink is induced through the filter material 2. The mass flow rate of the ink increases with an increase in the pressure gradient and the effective filtration surface area. Because a high effective filtration surface area can be obtained in a reasonably small filter according to the present invention, an excessively high pressure gradient is not needed in order to induce a high ink flow rate.

In the embodiment shown in FIG. 3, ink flows through the filter 1 from the inside out. In other words, ink flows first through the ink entrance 22 to accumulate in the chamber 8 of the filter 1. Due to a pressure gradient (regulated by regulator 10) between the inside (chamber 8) of the filter 1 and the outside of the filter 1 (i.e., the remainder of the interior of the pen body 12), ink is induced to flow through the filter material 2 of the filter 1. The filtered ink then accumulates inside the pen body 12, where it is available for use by a nozzle. However, in this embodiment, as well as all other embodiments, the filter 1 could be modified so that the ink flows from the outside in.

Figure 6:
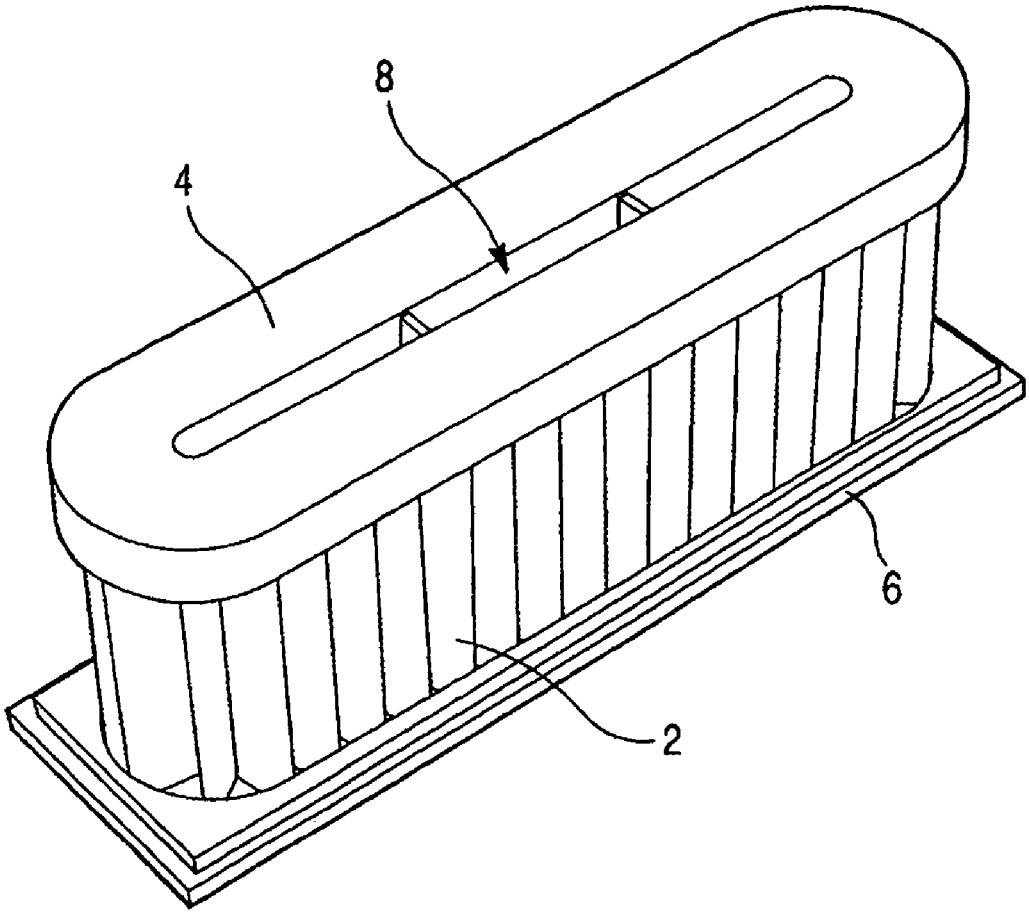
FIG. 6 is a perspective view of a filter according to the second embodiment of the present invention.
Figure 7:
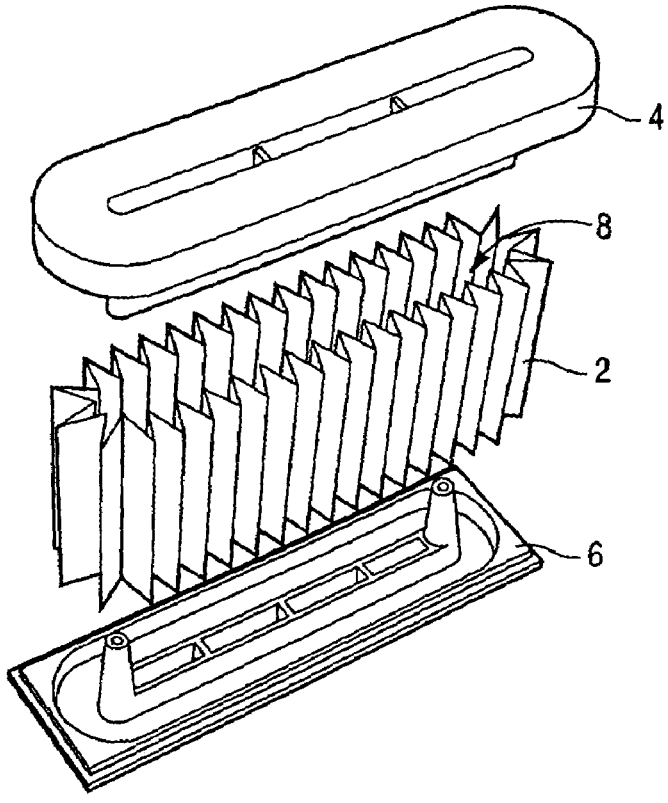
FIG. 7 is an exploded view of the filter shown in FIG. 6.

Referring to FIGS. 6 and 7, features similar to features in previous drawings will be designated by the same reference numbers. In a second embodiment, a filter 1 with an oval or elliptical cross section comprises a filter cap 6, an ink passage flange 4, and a pleated filter material 2 therebetween enclosing a chamber 8. The filter material 2 is attached to the filter cap 6 and the ink passage flange 4 as described previously. This embodiment differs from the first embodiment primarily in that the chamber 8 is smaller (thinner) and is not designed to accommodate or house a pressure regulator. This embodiment has the advantage that the ink passage flange 4 is easily closed or sealed with, for example, a piece of adhesive tape or shrink wrapping. By sealing the ink passage flange 4 just after the filter is manufactured and removing the seal just before the filter is installed in an ink jet pen, contamination on the inside of the chamber 8 can be prevented. Further, if the filter is intended for flowing ink from the outside in, the ability to prevent contamination of the chamber 8 is even more valuable, because less care need be taken for preventing the contamination of the outside of the filter.

Figure 8:
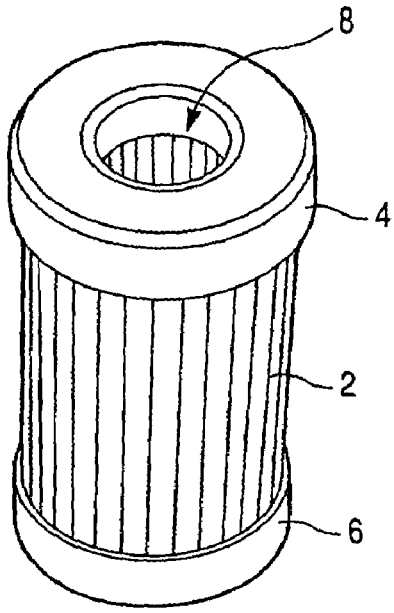
FIG. 8 is a perspective view of a filter according to the third embodiment of the present invention.

Referring now to FIG. 8, a third embodiment of the present invention is a cylindrical filter, with features similar to those of the previously discussed embodiments.

Figure 11:
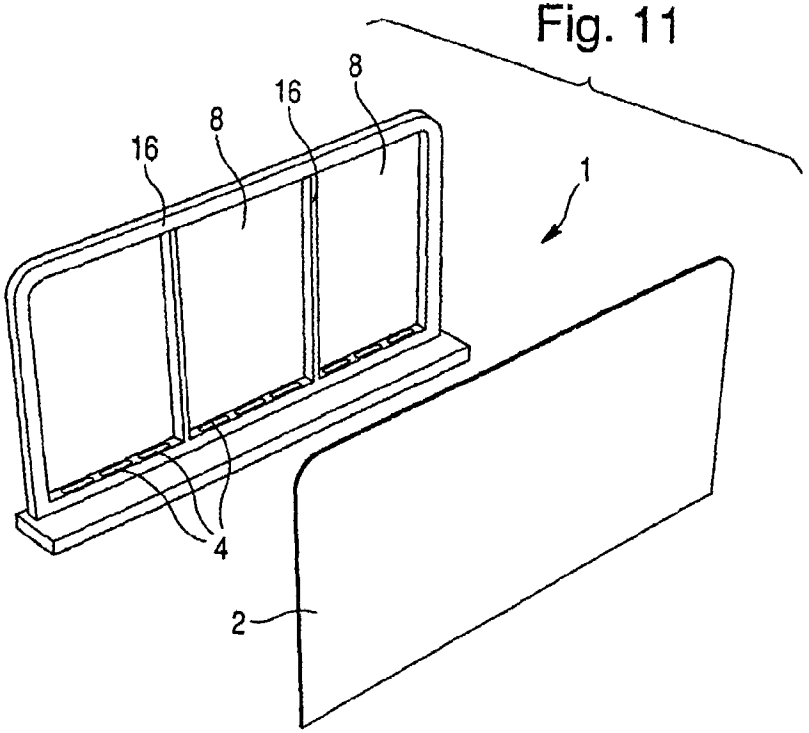
FIG. 11 is an exploded view of the filter shown in FIG. 10.

A fourth embodiment is shown in FIGS. 9–11. An ink jet pen includes a pen body 12, a filter 1, a regulator 10, a pen cap (not shown), and an ink entrance 22. The pen body 12 includes at least one ink exit 20 to which the filter 1 is attached via the ink passage flanges 4. The filter 1 comprises ribs 16, ink passage flanges 4, and two substantially flat (versus pleated) sheets of filter material 2 enclosing chambers 8.

In this embodiment, ink enters the pen body 12 through the ink entrance 22. Then, by means of a pressure gradient regulated by the regulator 10, ink is induced to flow through filter material 2 and into chambers 8 inside the filter 1. From there, the ink flows through the ink passage flanges 4 and through the ink exits 20. Then, the ink flows to a nozzle (not shown) that may or may not be directly attached to the pen body 12. Therefore, in this embodiment, the flow of ink through the filter 1 is outside in.

In this embodiment, the filter 1 is substantially rectangular and thin in width. For example, it may be approximately 5 mm thick. As shown in the example of FIG. 11, the filter 1 comprises ribs 16, chambers 8, several ink passage flanges 4, and two sheets of filter material 2. The two sheets of filter material 2 are substantially parallel and are separated by the ribs 16, which provide structural support to the filter 1 and prevent the two sheets of filter material 2 from being pushed into contact with each other due to the pressure gradient in the pen body 12. The two sheets of filter material 2 are attached to opposite sides of the ribs 16 with an adhesive or by melting, as discussed previously. This embodiment differs from the previous embodiments primarily in that it is thin and the filter material 2 is flat instead of pleated. Further, there are two sheets of filter material 2 instead of one sheet that is looped.

Figure 12:
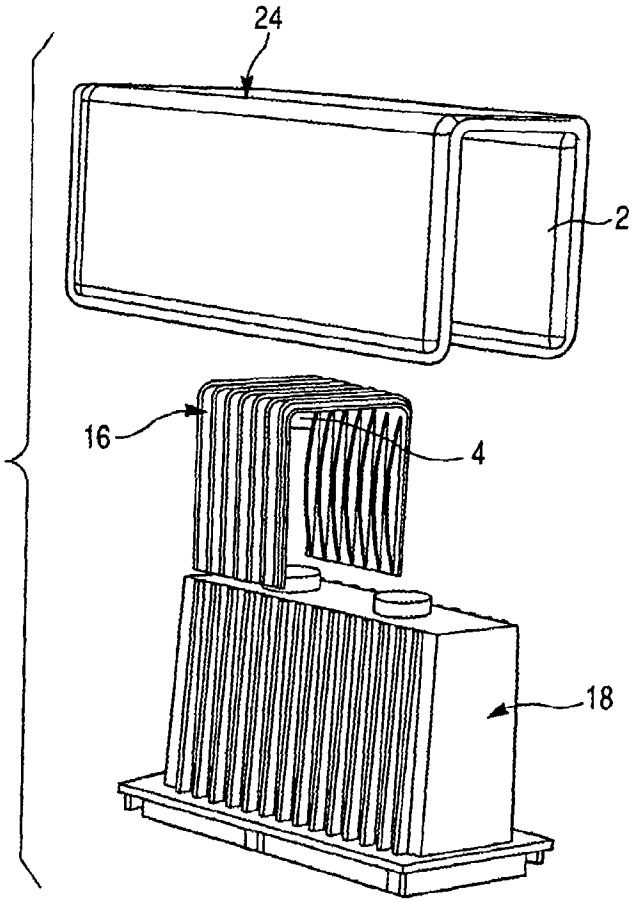
FIG. 12 is an exploded view of a filter according to the fifth embodiment of the present invention.
Figure 14:
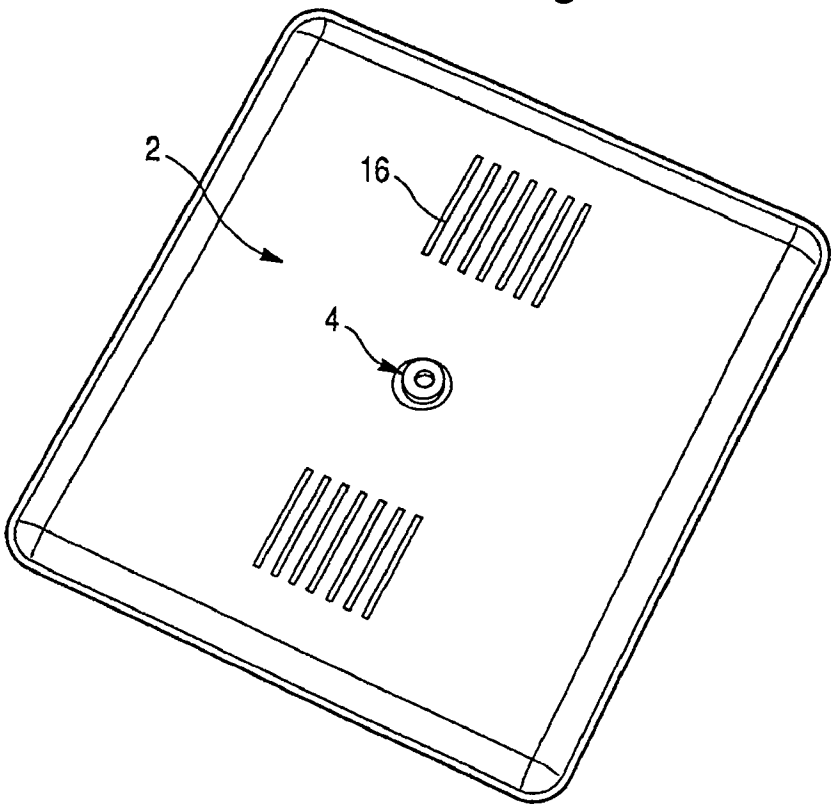
FIG. 14 is a perspective view of the filter shown in FIG. 13 in an unfolded state.
Figure 13:
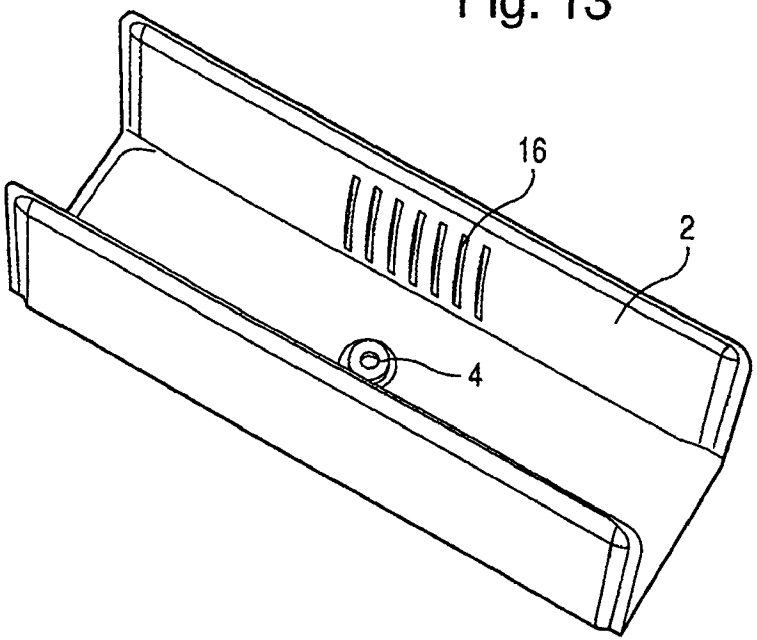
FIG. 13 is a perspective view of the filter shown in FIG. 12.

Referring now to FIGS. 12–14, according to a fifth embodiment of the present invention, a filter comprises a filter mount 18, ribs 16, an ink passage flange 4, and a filter bag 24 made of filter material 2. FIG. 12 shows an exploded view of this embodiment; however, once assembled, the ribs 16 are actually inside the filter bag 24, as shown in FIGS. 13–14. The filter bag 24 comprises filter material 2 that is configured as a bag. The filter bag 24, as shown in FIG. 14, is a flat bag with only one opening (the ink passage flange 4). In other words, the filter bag 24 is analogous to a flattened version of the hollow cube-shaped filter of FIG. 1. Such a configuration can be achieved in several ways. For example, two sheets of filter material 2 could be stitched or glued to each other at their periphery, as shown by the peripheral lines on the filter bag 24 in FIG. 14. Other means of forming a bag shape out of the filter material 2 would be obvious to one skilled in the art.

Before sealing the edges of the filter bag 24, the ribs 16 (shown in FIG. 12) should be inserted, so that the ribs 16 are inside of the sealed filter bag 24, leaving the ink passage flange 4 as the only opening into and out of the filter bag 24. As shown in FIGS. 12 and 13, the bag is preferably folded around the filter mount 18, resulting in two folds. In the absence of ribs 18, these folds could potentially retard or prevent flow around the folds. The ribs 16, as discussed with regard to a previous embodiment, provide structural support to the filter 1, and provide a flow channel through the filter bag 24 around the folds. Further, in the case of flow that is outside in, the ribs 16 prevent the two sheets of filter material 2 from being pushed into contact with each other due to the pressure gradient in the pen body 12. The filter mount 18 is a structural object and is an optional part of the filter. It could, for example, house a regulator (not shown), as discussed in regard to a previous embodiment.

In the fifth embodiment, the flow of ink is either inside out or outside in. In the case of flow that is outside in, the filter mount 18 is attached to an ink exit 20. When an ink pressure gradient occurs inside the pen body 12, a flow of ink is induced through the filter material 2. Once the ink is inside the filter bag 24, it flows along the ribs 16 toward the ink passage flange 4. The ink continues through the ink passage flange 4, the filter mount 18, and finally through the ink exit 20 to a nozzle (not shown).

The different embodiments described above are examples only. A filter according to the present invention can take on many different shapes and configurations to meet the specifications of a given ink jet pen, as would be obvious to one skilled in the art.

The foregoing description of the preferred embodiments of the invention has been presented for purposes of illustration and description. It is not intended to be exhaustive or to limit the invention to the precise form disclosed, and modifications and variations are possible in light in the above teachings or may be acquired from practice of the invention. The embodiments were chosen and described to explain the principles of the invention and as a practical application to enable one skilled in the art to utilize the invention in various embodiments and with various modifications suited to the particular use contemplated. It is intended that the scope of the invention be defined by the claims appended hereto and their equivalents.

What is claimed is:

1. An inkjet pen, comprising:

a pen body having an interior chamber;

a pen cap;

an ink filter within the pen body interior chamber, the ink filter having a hollow interior encircled by a filter material, the filter material formed in pleats comprising multiple substantially parallel folds with adjacent folds alternating in direction, the filter having at least one open end;

a pressure regulator within pen body interior chamber, the pressure regulator nested within the hollow interior of the filter;

the pen cap substantially closing the pen body interior chamber when the pen cap and pen body are coupled together.

2. The inkjet pen of claim 1, wherein the pressure regulator is affixed to the pen cap and suspended within the filter hollow interior.

3. The inkjet pen of claim 1, wherein the pen cap further comprises an ink entrance.

4. The inkjet pen of claim 1, wherein the filter material has a pore size substantially in the range of 2 microns to 10 microns.

5. The inkjet pen of claim 1, wherein the ink filter further comprises a substantially rigid ink passage flange supporting the pleated filter material.

6. The inkjet pen of claim 5, wherein the substantially rigid ink passage flange is attached to the pleated filter material with an adhesive.

7. The inkjet pen of claim 1, wherein the ink filter further comprises a substantially rigid filter cap supporting the pleated filter material.

8. The inkjet pen of claim 7, wherein the substantially rigid filter cap is attached to the pleated filter material with an adhesive.

* * * * *